US011527394B2

(12) United States Patent
Thoeing et al.

(10) Patent No.: US 11,527,394 B2
(45) Date of Patent: Dec. 13, 2022

(54) METHODS AND APPARATUS FOR DETERMINING INTERFERENCE IN MS SCAN DATA, FILTERING IONS AND PERFORMING MASS SPECTROMETRY ANALYSIS ON A SAMPLE

(71) Applicant: Thermo Fisher Scientific (Bremen) GmbH, Bremen (DE)

(72) Inventors: Christian Thoeing, Blender (DE); Anastassios Giannakopulos, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 17/243,464

(22) Filed: Apr. 28, 2021

(65) Prior Publication Data

US 2021/0375605 A1 Dec. 2, 2021

(30) Foreign Application Priority Data

May 28, 2020 (EP) ..... 20177136

(51) Int. Cl.
*H01J 49/00* (2006.01)
*H01J 49/06* (2006.01)

(52) U.S. Cl.
CPC ..... *H01J 49/0036* (2013.01); *H01J 49/0031* (2013.01); *H01J 49/0045* (2013.01); *H01J 49/062* (2013.01)

(58) Field of Classification Search
CPC ..... H01J 49/0036; H01J 49/0031; H01J 49/0045; H01J 49/062; G01N 27/62; G01N 1/34

(Continued)

(56) References Cited

U.S. PATENT DOCUMENTS 6,906,320 B2 * 6/2005 Sachs ..... H01J 49/0036 250/282
2010/0286927 A1 * 11/2010 Horn ..... H01J 49/0036 250/282

OTHER PUBLICATIONS

Lawson et al., "msPurity: Automated Evaluation of Precursor Ion Purity for Mass Spectrometry-Based Fragmentation in Metabolomics", Anal. Chem. 2017, vol. 89 (4), pp. 2432-2439.

(Continued)

*Primary Examiner* — Michael Maskell
(74) *Attorney, Agent, or Firm* — Thomas F. Cooney

(57) ABSTRACT

A method of determining one or more interference parameters for a particular peak of an isotopic distribution corresponding to a precursor molecule in MS scan data is provided. The MS scan data comprises a plurality of peaks. Each peak has a mass-to-charge ratio and a relative abundance. The isotopic distribution comprises a subset of the plurality of peaks. The one or more interference parameters comprises a peak purity, $p_i$, for the particular peak. The method comprises determining that there are no interfering peaks relevant to the isotopic distribution and determining that the peak purity, $p_i$, for the particular peak should be a maximum purity value. Alternatively, the method comprises identifying one or more interfering peaks from the MS scan data, wherein the one or more interfering peaks do not belong to the subset of peaks of the isotopic distribution, and determining the peak purity, $p_i$, for the particular peak based on: the relative abundance, $I_i$, of the particular peak, and the relative abundance of the one or more interfering peaks.

10 Claims, 6 Drawing Sheets

(58) Field of Classification Search
USPC ..... 250/281, 282; 702/14, 23; 436/173
See application file for complete search history.

(56) References Cited

OTHER PUBLICATIONS

Lawson et al., "Supporting Information: msPurity: Automated Evaluation of Precursor Ion Purity for Mass Spectrometry Based Fragmentation in Metabolomics", XP055742744, (2017), 13 pages, URL: https://pubs.acs.org/doi/suppl/10.1021/acs.analchem.6b04358/suppl file/ac6b04358si 001.pdf.

* cited by examiner $$p_c = (p_{ISD} - p_i)\frac{(W/2 - d_{interf})}{(w_{ISD/2} - d_{interf})} + p_i$$

METHODS AND APPARATUS FOR DETERMINING INTERFERENCE IN MS SCAN DATA, FILTERING IONS AND PERFORMING MASS SPECTROMETRY ANALYSIS ON A SAMPLE

CROSS REFERENCE TO RELATED APPLICATION

This application claims, under 35 U.S.C. 119(a), the right of priority to European patent application No. EP20177136, which was filed on May 28, 2020, the disclosure of which is incorporated herein by reference in its entirety.

FIELD OF THE INVENTION

The present disclosure is directed to the field of mass spectrometry. More particularly, the present disclosure relates to methods and systems for determining levels of interference of isotopic clusters during precursor ion analysis.

BACKGROUND

Molecules of a sample may be identified by preparing the sample and observing the sample molecules (the precursors) in mass spectra (MS) by their mass peak. Each precursor molecule species may result in multiple peaks in the mass spectrum because of isotopes of that molecule being present in the sample. The cluster of peaks all relating to the same precursor molecule may be referred to as an isotopic cluster or isotopic distribution. To identify the precursor, ions in a mass window W around the mass peak of the isotopic cluster may be isolated, fragmented and then the mass spectrum ($MS^2$) of the fragments may be analysed to identify the molecule, based on the fragment spectrum.

In the mass window around the isotopic cluster of the ions of a target precursor molecule, mass peaks belonging to an isotopic cluster of a different precursor molecule may also be observed. This effect of interference of the isotopic clusters of different molecules complicates the identification of molecules by their fragments observed in the $MS^2$ mass spectra.

In view of the above problem, it is preferred to analyse precursor molecules having isotopic clusters that are not influenced or not essentially influenced by interference from another isotopic cluster. Another term to describe the influence of interference is the "purity" of a mass range of a mass spectrum or also called a "non-interference score".

U.S. Pat. No. 9,583,323 proposes to take $MS^2$ mass spectra of different mass window sizes W and to identify the mass scans as free of interference when the same peaks are observed for different mass windows.

On the approach suggested in U.S. Pat. No. 9,583,323, comparison of various isolation windows used at different extracted ion chromatogram (XIC) widths is used. In various embodiments the tandem mass spectrometer performs a single precursor scan and multiple fragmentation scans at multiple mass selection window widths across a mass range that allow post acquisition processing to be run after a single run of tandem mass spectrometer. The tandem mass spectrometer analyses the first sample using a single mass spectrometry scan of one or more precursor ions and two or more mass spectrometry scans of the product ions using two or more isolation windows widths across the mass range. The two or more isolation windows widths can be uniform or variable. In a further step, the product ion is identified as not including an interference, if the first set of one or more peak parameters and the second set of one or more peak parameters are substantially the same.

U.S. Pat. No. 8,455,818 proposes to identify an amount of interference defined by the intensity ratio of an investigated precursor peak and the intensity of an interfering peak. When the value of amount of interference is lower or the precursor purity higher than a threshold for a precursor ion, the $MS^2$ mass spectra of the precursor ions will be detected. Otherwise the precursor ion will be subjected to a purification process.

U.S. Pat. No. 8,455,818 describes a predefined window in which interference from non-related peaks is assessed. This document further describes a method of analysing an analyte using mass spectrometry, the method comprising: providing an analyte; generating a distribution of precursor ions from the analyte; analysing the mass-to-charge ratios of at least a portion of the distribution of precursor ions, thereby generating precursor ion mass spectrometry data corresponding to the distribution of precursor ions; identifying a precursor peak in the precursor ion mass spectrometry data corresponding to a precursor ion; determining the amount of interference within a preselected range of m/z units about the precursor peak, wherein the preselected range is within 0.01 to 10 m/z units of the precursor peak; and fragmenting ions corresponding to the preselected range of m/z units about the precursor peak when the amount of interference is less than a selected value, thereby generating fragment ions; and not fragmenting ions corresponding to the preselected range of m/z units about the precursor peak when the amount of interference is greater than or equal to the selected value.

Another approach is described in WO 2016198984. This document identifies the precursor ion peak in a precursor ion spectrum produced in a MS survey scan step, determines if the precursor ion peak in the precursor ion spectrum includes a feature of convolution, and if the precursor ion peak includes a feature of convolution, instructs the mass spectrometer to prevent the precursor ion peak from being excluded in a filtering step of one or more subsequent cycles of the plurality of cycles.

Purity at predefined window is examined in document GB 2471155, where methods of analysing data from a mass spectrometer are discussed for a data dependent acquisition. The method comprises: obtaining a mass spectrum of a sample, wherein the mass spectrum includes isotopic clusters of interest; for each isotopic cluster of interest, using an isolation window of predefined width along an m/z axis of the mass spectrum, using a computer configured for data dependent acquisition to isolate a portion of the mass spectrum; for each isotopic cluster of interest, calculating, using the computer configured for data dependent acquisition, a purity value for the respective isotopic cluster of interest located within the isolation window; calculating a selection score for each isotopic cluster of interest, based on each said purity value, respectively; and selecting one or more of the isotopic clusters of interest having the highest selection scores for further analysis thereof.

Against this background, the present invention aims to provide improved methods for determining the level of purity for each isotopic cluster and/or the level of purity of individual peaks in the cluster. The present invention also provides methods to improve the quality of information derived from mass spectrometry analysis, based on the level of purity for each isotopic cluster and/or the level of purity of individual peaks in the cluster.

SUMMARY

A method of determining one or more interference parameters for a particular peak of an isotopic distribution corresponding to a precursor molecule in MS scan data is provided. The MS scan data comprises a plurality of peaks, each peak having a mass-to-charge ratio and a relative abundance. The isotopic distribution comprises a subset of the plurality of peaks. The one or more interference parameters comprises a peak purity, $p_i$, for the particular peak.

The method may comprise identifying one or more interfering peaks from the MS scan data that do not belong to the subset of peaks of the isotopic distribution and determining the peak purity, $p_i$, for the particular peak based on: the relative abundance, $I_i$, of the particular peak, and the relative abundance of the one or more interfering peaks.

Alternatively, the method may comprise determining that there are no interfering peaks relevant to the isotopic distribution. In this case, the peak purity for the particular peak may be a maximum purity value (for example, the peak purity may be 1 where the possible range of purity values is between 0 and 1).

Advantageously, the method provides a peak purity for each individual peak in the isotopic distribution. The peak purity may be used to make decisions relating to subsequent steps in a multi-step spectrometry process. For example, the peak purity may be used to filter out peaks that have low purity scores.

As discussed above, the MS scan data comprises a plurality of "peaks". In this application, the work "peak" refers to a statistically significant reading of ion detection above the background noise level. In other words, the signal-to-noise ratio (SNR) of the ion detector reading at an m/z value corresponding to a peak is above a detection threshold. The SNR threshold may be 10:1, 5:1 or 1:1 (or 10 dB, 7 dB or 0 dB) for example.

The isotopic distribution may be one of a plurality of isotopic distributions. The MS scan data may comprise data assigning subsets of the plurality of peaks to the isotopic distributions. Each peak may be assigned to an isotopic distribution with a confidence value (e.g. a probability between 0 and 1).

The peak purity for the particular peak may be related to (and provide a measure of) the interference from neighbouring peaks that do not belong to the isotopic distribution.

Determining the peak purity, $p_i$, for the particular peak based on the relative abundance of the one or more interfering peaks may comprise selecting a first interfering peak of the one or more interfering peaks and determining the peak purity, $p_i$, for the particular peak based on the relative abundance, $I_{interf}$, of the first interfering peak. In some cases:

$$p_i = I_i/(I_i + I_{interf}).$$

The interfering peak may be a nearest interfering peak having a relative abundance above an interference threshold, such that the mass-to-charge ratio of the first interfering peak is closer to the mass-to-charge ratio of the particular peak of the isotopic distribution than any other peak in the MS scan data not belonging to the subset of peaks in the isotopic distribution and having a relative abundance above the interference threshold.

If more than one interfering peak is the same distance from the particular peak (i.e. two interfering peaks having a relative abundance above an interference threshold and both having the same absolute difference between their mass-to-charge ratio and that of the particular peak of the isotopic distribution) then the interfering peak of these having the highest relative abundance may be selected as the nearest interfering peak.

The one or more interference parameters may further comprise an interference distance, $d_{interf}$, for the particular peak, wherein the interference distance, $d_{interf}$, is based on the difference between the mass-to-charge ratio of the particular peak, $M_i$, and the mass-to-charge ratio of the first interfering peak, $M_{interf}$. In some cases $$d_{interf} = |M_{interf} - M_i|.$$

The interference distance may relate to the m/z "distance" of a nearest interfering peak, where the "distance" is the distance along the m/z axis (difference between the mass-to-charge ratio of the particular peak, $M_i$, and the mass-to-charge ratio of the first interfering peak, $M_{interf}$). Other m/z differences may likewise be referred to as "distances" in this application.

The one or more interference parameters may further comprise an isotopic m/z window, $w_{ISD}$, of the isotopic distribution. The isotopic m/z window may define a range of mass-to-charge ratios that includes every peak of the isotopic distribution having a relative abundance above an inclusion threshold.

The isotopic m/z window, $w_{ISD}$, may be a range of m/z vales and therefore may be defined by two separate parameters: the start point of the isotopic m/z window, $w_{ISDstart}$, and the end point of the isotopic m/z window, $w_{ISDend}$.

The inclusion threshold may be set as a proportion of a most abundant peak in the isotopic distribution or a most abundant peak in the MS data. The proportion may be 1%, 5%, 10% or 20%, for example. The proportion may be 0%, which would indicate that all peaks in the isotopic distribution should be included in the isotopic m/z window.

The "most abundant" peak is the peak that has the highest relative abundance.

The isotopic m/z window may be centred on a mass-to-charge ratio, $M_0$, of a most abundant peak of the isotopic distribution having the highest relative abundance, $I_0$, of the peaks in the isotopic distribution. A half-width, $w_{ISD/2}$, of the isotopic m/z window may be defined as the absolute difference between the mass-to-charge ratio of the most abundant peak of the isotopic distribution and the mass-to-charge ratio of a furthest significant peak of the isotopic distribution. The furthest significant peak may be defined as a peak in the isotopic distribution that has:

a) a relative abundance above the inclusion threshold; and
b) a mass-to-charge ratio that is furthest from the most abundant peak of the isotopic distribution, such that the absolute difference between the mass-to-charge ratio of the furthest significant peak and the most abundant peak is greater than the absolute difference between the mass-to-charge ratio of the most abundant peak and any other peak in the isotopic distribution having a relative abundance above the inclusion threshold.

Alternatively, a lower boundary and an upper boundary of the isotopic m/z window may be defined by the lowest and highest mass-to-charge ratios respectively of a further subset of peaks of the isotopic distribution having relative abundances above the inclusion threshold. In this case, the isotopic m/z window may not be centred on the most abundant peak.

If more than one peak in the isotopic distribution above the inclusion threshold has the same absolute m/z difference to the most abundant peak then one peak may be selected at random (and the resulting isotopic m/z window will include both peaks).

Determining that there are no interfering peaks relevant to the isotopic distribution may comprise determining that the range of mass-to-charge ratios defined by the isotopic m/z window does not contain any peaks that do not belong to the subset of peaks of the isotopic distribution and have a relative abundance above an interference threshold.

Identifying one or more interfering peaks from the MS scan data may comprise identifying peaks having a mass-to-charge ratio within the isotopic m/z window (i.e. within the range of m/z values defined by the isotopic m/z window) and having a relative abundance above an interference threshold.

The interference threshold may be set as a proportion of any one of: the particular peak, a most abundant peak in the isotopic distribution or a most abundant peak in the MS data. The proportion may be 1%, 5%, 10% or 20%, for example. The proportion may be 0%, which would indicate that all interfering peaks should be considered regardless of how small they may be.

The one or more interference parameters may further comprise an isotopic purity, $p_{ISD}$, for the isotopic distribution. The method may further comprise determining a total relative abundance, $S_{iso}$, of the subset of peaks belonging to the isotopic distribution and a total relative abundance, $S_{interf}$, of the subset of peaks that do not belong to the isotopic distribution. The method may further comprise determining the total relative abundance of all of the peaks in the MS scan having a mass-to-charge ratio falling within the range defined by the isotopic m/z window. The method may further comprise using the total relative abundance for the subset of peaks, $S_{iso}$, and the total relative abundance for all of the peaks in the isotopic m/z window to determine the isotopic purity, $p_{ISD}$. In some cases:

$$p_{ISD}=S_{iso}/(S_{iso}+S_{interf}).$$

The isotopic purity may be related to (and may be a measure of) a level of interference for the entire isotopic distribution from peaks that do not belong to the isotopic distribution.

Determining a total relative abundance, $S_{iso}$, of the subset of peaks belonging to isotopic distribution may involve summing the relative abundances of all of the peaks in the isotopic distribution. Alternatively, this may involve only summing the relative abundances of all of the peaks in the isotopic distribution having a relative abundance above the inclusion threshold. Alternatively, this may involve only summing the relative abundances of all of the peaks in the isotopic distribution having a mass-to-charge ratio falling within the range defined by the isotopic m/z window. Alternatively, this may involve only summing the relative abundances of all of the peaks in the isotopic distribution having a relative abundance above the inclusion threshold AND having a mass-to-charge ratio falling within the range defined by the isotopic m/z window.

Determining the total relative abundance of all of the peaks in the MS scan having a mass-to-charge ratio falling within the range defined by the isotopic m/z window may involve summing the relative abundances of all of the peaks having a mass-to-charge ratio falling within the range defined by the isotopic m/z window. Alternatively, this may involve summing the relative abundances of all of the peaks having a mass-to-charge ratio falling within the range defined by the isotopic m/z window AND having a relative abundance above an interference threshold.

A method of selecting an isolation window around an isotopic distribution corresponding to a precursor molecule in MS scan data is provided. The MS scan data comprises a plurality of peaks, each peak having a mass-to-charge ratio and a relative abundance. The isotopic distribution comprises a subset of the plurality of peaks. The method comprises determining a peak purity, $p_i$, for each peak of the first isotopic distribution by a method as described above. The method further comprises determining a purity score, $s_i$, for each peak of the first isotopic distribution based on the peak purity. The method further comprises defining a lower boundary, $W_{start}$, and an upper boundary, $W_{end}$, of the isolation window so that only peaks of the isotopic distribution having a purity score above a predetermined threshold, T, are included in the isolation window.

In other words, the isolation window may be defined such that only sufficiently pure peaks have mass-to-charge ratios between the upper and lower boundaries. Boundaries are set so that peaks having a purity value below the threshold are excluded from the isolation window.

The predetermined threshold, T, may be set anywhere between the highest and lowest possible values of the purity score. For example, the purity score may be in the range 0 to 1. In this case, the predetermined threshold (purity threshold) may be 0.1, 0.2, 0.3, 0.4, 0.5, 0.6, 0.7, 0.8, or 0.9, for example. The purity threshold may be 1, which would indicate that only peaks that are not subject to any interference should be included in the isolation window. The purity threshold may be 0.01 or 0.001, which would indicate that peaks having very high levels of interference should be excluded from the isolation window (filtered).

Each isotopic distribution may comprise a subset of the plurality of peaks. Each peak may be assigned to a particular isotopic distribution with a defined probability. Some peaks may be assigned to more than one isotopic distribution with respective probabilities for each. Some peaks may not be assigned to an isotopic distribution.

The purity score, $s_i$, may be further based on one or more of: an isotopic m/z window, $w_{ISD}$, of the isotopic distribution; the isotopic purity for the first isotopic distribution, $p_{ISD}$; and/or the interference distance, $d_{interf}$, for the particular peak. In some cases:

$$s_i=\min(p_{ISD},p_i)^{1/k}$$

$$k=2^n \text{ if } 0.7n\leq d<0.7(n+1), n=0,1,2,\ldots$$

$$d=\min(d_{interf}, w_{ISD/2})$$

$$\text{or } k=2^n \text{ where } n=\text{floor}(d/0.7)$$

where "floor(d/0.7)" means the whole number part of d divided by 0.7 (discarding any remainder) and may also be written as int(d/0.7) or round down (d/0.7), for example.

The isolation window may be centred around a peak of the corresponding subset of the plurality of peaks having the highest relative abundance. Setting the lower boundary of the isolation window and the upper boundary of the isolation window may comprise defining a width of the isolation window so that only peaks of the isotopic distribution having a purity score below the predetermined threshold, T, are included in the isolation window.

Alternatively, a lower boundary and an upper boundary of the isolation window may be defined by relative to the mass-to-charge ratios of peaks of the isotopic distribution nearest to the most abundant peak above and below and having purity scores below the inclusion threshold so that these nearest peaks above and below are excluded from the isolation window but all peaks between these peaks are included in the isolation window.

A method of determining one or more interference parameters for an isotopic distribution corresponding to a precursor molecule in an MS scan is provided. The MS scan comprises a plurality of peaks, each peak having a mass-to-charge ratio and a relative abundance. The isotopic distribution may comprise a subset of the plurality of peaks.

The one or more interference parameters comprises an isotopic m/z window and an isotopic purity. The method comprises determining the isotopic m/z window, $w_{ISD}$, of the isotopic distribution, wherein the isotopic m/z window of the isotopic distribution defines a range of mass-to-charge ratios that includes every peak of the isotopic distribution that has a relative abundance above an inclusion threshold. The isotopic m/z window is centred on a mass-to-charge ratio of a most abundant peak of the isotopic distribution, $M_0$, having the highest relative abundance, $I_0$, of the peaks in the isotopic distribution.

A half-width, $w_{ISD/2}$, of the isotopic m/z window is defined as the absolute difference between the mass-to-charge ratio of the most abundant peak of the isotopic distribution and the mass-to-charge ratio of a furthest significant peak of the isotopic distribution. The furthest significant peak has:

a) a relative abundance above the inclusion threshold; and b) a mass-to-charge ratio that is furthest from the most abundant peak of the isotopic distribution, such that the absolute difference between the mass-to-charge ratio of the furthest significant peak and the most abundant peak is greater than the absolute difference between the mass-to-charge ratio of the most abundant peak and any other peak in the isotopic distribution having a relative abundance above the inclusion threshold. The method further comprises determining a total relative abundance of the subset of peaks belonging to isotopic distribution, $S_{iso}$. The method further comprises determining the total relative abundance of all of the peaks in the MS scan having a mass-to-charge ratio falling within the range defined by the isotopic m/z window. The method further comprises using the total relative abundance for the subset of peaks, $S_{iso}$, and the total relative abundance for all of the peaks in the isotopic m/z window to determine an isotopic purity, $p_{ISD}$, that is related to the level of interference within the isotopic m/z window of the isotopic distribution.

Advantageously, the method provides an isotopic purity for each isotopic distribution in the MS scan data. The isotopic purity may be used to make decisions relating to subsequent steps in a multi-step spectrometry process. For example, the isotopic purity may be used to decide an order in which to subject isotopic distributions to further analysis or provide a selection criterion for isotopic distributions.

An isotopic distribution purity score (or "cluster overlap score") may be calculated based on the one or more interference parameters for the isotopic distribution.

Determining the total relative abundance of all of the peaks in the MS scan having a mass-to-charge ratio falling within the range defined by the isotopic m/z window may comprise:

determining the total relative abundance, $S_{interf}$, of all of the peaks in the MS scan having a mass-to-charge ratio falling within the range defined by the isotopic m/z window not belonging to the subset of peaks in the isotopic distribution and having a relative abundance above the interference threshold; and calculating the total relative abundance of all of the peaks in the MS scan having a mass-to-charge ratio falling within the range defined by the isotopic m/z window as the sum of:

the total relative abundance, $S_{interf}$, of all of the peaks in the MS scan having a mass-to-charge ratio falling within the range defined by the isotopic m/z window not belonging to the subset of peaks in the isotopic distribution and having a relative abundance above the interference threshold, and the total relative abundance, $S_{iso}$, of the subset of peaks belonging to isotopic distribution.

A method of selecting for further analysis one or more isotopic distributions in MS scan data is also provided. Each isotopic distribution corresponds to a respective precursor molecule. The MS scan data comprises a plurality of peaks, each peak having a mass-to-charge ratio and a relative abundance. Each isotopic distribution comprises a subset of the plurality of peaks. The method comprises, for each of the one or more isotopic distributions in the MS scan:

determining an isotopic purity, $p_{ISD}$, related to the level of interference within an isotopic m/z window, $w_{ISD}$, of the isotopic distribution using a method described above and determining an isotopic distribution purity score based on the isotopic m/z window, $w_{ISD}$, and/or the isotopic purity, $p_{ISD}$. and selecting for further analysis one or more isotopic distributions having respective isotopic distribution purity scores above a predetermined threshold.

The predetermined threshold may be set anywhere between the highest and lowest possible values of the isotopic distribution purity score. For example, the isotopic distribution purity score may be in the range 0 to 1. In this case, the predetermined threshold (or "isotopic distribution purity threshold") may be 0.1, 0.2, 0.3, 0.4, 0.5, 0.6, 0.7, 0.8, or 0.9, for example. The predetermined threshold may be 1, which would indicate that only isotopic distributions that are not subject to any interference should be selected for further analysis. The predetermined threshold may be 0.01 or 0.001, which would indicate that isotopic distributions having very high levels of interference should be excluded from further analysis (filtered).

The isotopic distribution purity score may be based the one or more interference parameters for the isotopic distribution. The isotopic distribution score may be the same as the isotopic purity.

A method of defining an order in which one or more isotopic distributions in MS scan data should be analysed is also provided. Each isotopic distribution in the MS scan data corresponds to a respective precursor molecule. The MS scan data comprises a plurality of peaks, each peak having a mass-to-charge ratio and a relative abundance. Each isotopic distribution comprises a subset of the plurality of peaks. The method comprises, for each of the one or more isotopic distributions in the MS scan, determining an isotopic purity, $p_{ISD}$, related to the level of interference within an isotopic m/z window, $w_{ISD}$, of the isotopic distribution using the method of claim 10 or claim 11 and determining an isotopic distribution purity score based on the isotopic m/z window, $w_{ISD}$, and/or the isotopic purity, $p_{ISD}$. The method further comprises ranking the one or more isotopic distributions based on the isotopic distribution purity score so that the order in which one or more isotopic distributions in MS scan data should be analysed is defined by the ranking.

A method of performing mass spectrometry analysis on a sample is also provided. The method comprises performing an MS scan on the sample and obtaining MS scan data, wherein the MS scan data comprises a plurality of peaks, each peak having a mass-to-charge ratio and a relative abundance. The method further comprises identifying one or more isotopic distributions in the MS scan data, each isotopic distribution corresponding to a precursor molecule contained within the sample, each isotopic distribution comprising a subset of the plurality of peaks. The method further comprises: selecting for further analysis one or more isotopic distributions from the one or more isotopic distributions identified in the MS scan data; and/or ranking the one or more isotopic distributions from the one or more isotopic distributions identified in the MS scan data for further analysis in an order according to the ranking. The method further comprises determining an isolation window around a first isotopic distribution of the selected one or more isotopic distributions, wherein the isolation window defines a range of mass-to-charge ratios. The method further comprises collecting ions having mass-to-charge ratios in the range defined by the isolation window. The method further comprises performing an $MS^2$ scan on the collected ions and obtaining $MS^2$ scan data.

Selecting for further analysis one or more isotopic distributions from the one or more isotopic distributions identified in the MS scan data may be performed using a method as described above.

Ranking the one or more isotopic distributions from the one or more isotopic distributions identified in the MS scan data for further analysis in an order according to the ranking may be performed using a method as described above.

Determining an isolation window around a first isotopic distribution of the selected one or more isotopic distributions, wherein the isolation window defines a range of mass-to-charge ratios, may be performed using a method as described above.

The method may further comprise identifying a precursor molecule corresponding to the first isotopic distribution, based on the $MS^2$ scan data.

The method may further comprise determining an isolation window around one or more further isotopic distributions of the selected one or more isotopic distributions. The method may further comprise, for each of the further isotopic distributions, collecting ions having mass-to-charge ratios in the range defined by the isolation window and performing an $MS^2$ scan on each of the collected ion samples and obtaining $MS^2$ scan data (along with the first isotopic distribution in an order defined by the ranking of the one or more selected isotopic distributions). The method may further comprise identifying precursor molecules corresponding to each of the further isotopic distributions, based on the $MS^2$ scan data.

Selecting for further analysis one or more isotopic distributions from the one or more isotopic distributions identified in the MS scan may comprise: for each of the one or more isotopic distributions identified in the MS scan, determining an isotopic purity, $p_{ISD}$, related to the level of interference within an isotopic m/z window, $w_{ISD}$, of the isotopic distributions and determining an isotopic distribution purity score based on the isotopic m/z window, $w_{ISD}$, and/or the isotopic purity, $p_{ISD}$; and selecting isotopic distributions having an isotopic distribution purity score above a predetermined threshold.

The method may further comprise ranking the one or more isotopic distributions selected for further analysis based on the isotopic distribution purity score. The method may further comprise performing an $MS^2$ scan on the collected ions and obtaining $MS^2$ scan data in an order defined by the ranking.

Methods may be combined in a number of ways. For example, isotopic distributions may be selected from the MS scan data for further analysis and/or ranked based on the purity of the isotopic distributions AND the isolation window for analysing each of those isotopic distributions using $MS^2$ may be selected. These filtering and ranking operations may be achieved using the interference parameters ($p_i$, $d_{interf}$, $p_{ISD}$ and $w_{ISD}$) calculated as described above.

An apparatus configured to perform any of the methods described above is also provided.

A computer program that comprises instructions that, when executed on a processor of a mass spectrometry system, cases the mass spectrometry system to perform the any of the methods described above is also provided.

BRIEF DESCRIPTION OF THE FIGURES

The above noted and various other aspects of the present invention will become further apparent from the following description which is given by way of example only and with reference to the accompanying drawings, not drawn to scale, in which.

DETAILED DESCRIPTION

Figure 1:
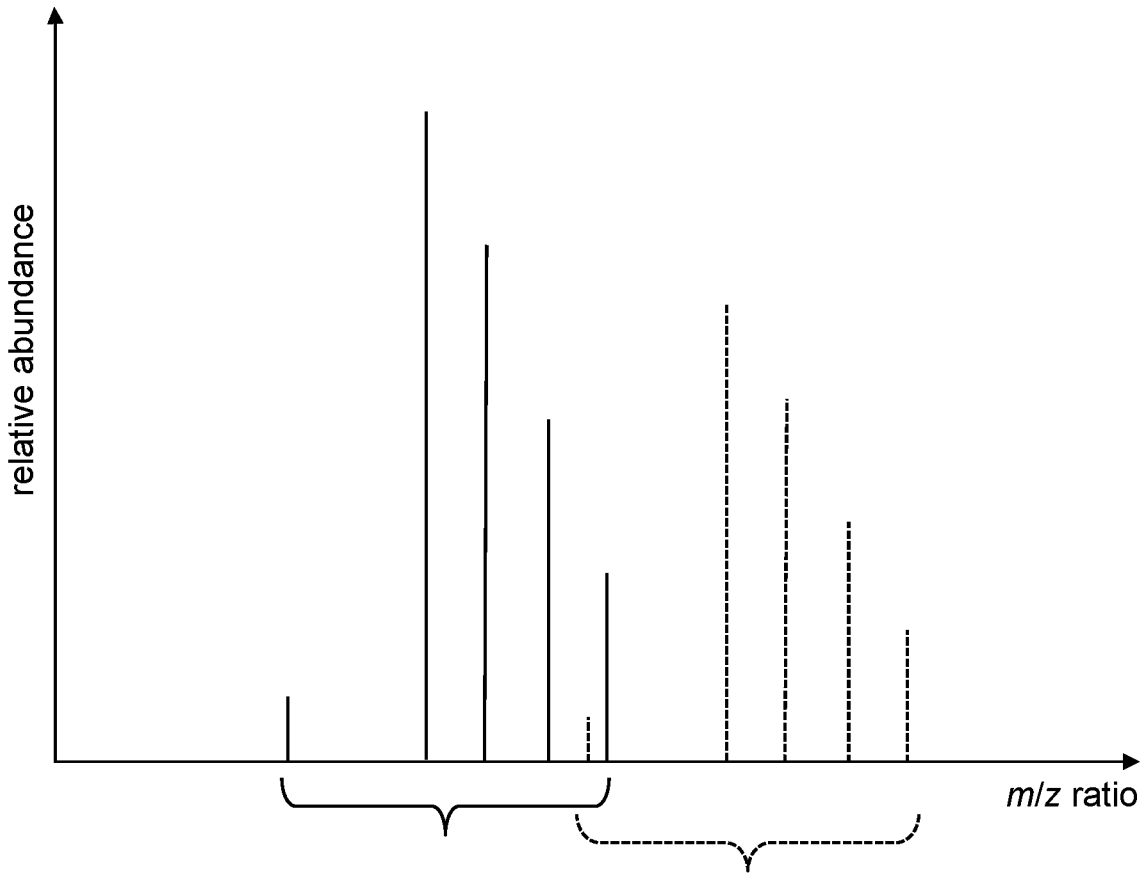
FIG. 1 shows a simplified example of a mass spectrum in which two isotopic clusters have been identified.

The following description is presented to enable any person skilled in the art to make and use the invention, and is provided in the context of a particular application and its requirements. Accordingly, the disclosed materials, methods, and examples are illustrative only and not intended to be limiting. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the figures taken in conjunction with the following description.

Unless otherwise defined, all technical and scientific terms used herein have the meaning commonly understood by one of ordinary skill in the art to which this invention belongs. In case of conflict, the present specification, including definitions, will control.

In this document, the terms "precursor ions", "precursor ion species", "first-generation ions" and "first-generation ion species" refer to ions as they are received by a mass analyzer from an ionization source in the absence of any controlled fragmentation in a fragmentation cell. The term "scan", when used as a noun, should be understood in a general sense to mean "mass spectrum" regardless of whether or not the apparatus that generates the scan is actually a scanning instrument. Similarly, the term "scan", when used as a verb, should be understood in a general sense as referring to an act or process of acquiring mass spectral data.

As used herein, "a" or "an" also may refer to "at least one" or "one or more." Also, the use of "or" is inclusive, such that the phrase "A or B" is true when "A" is true, "B" is true, or both "A" and "B" are true. Further, a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the disclosure. Also, reference numerals may be repeated among the various figures to show corresponding or analogous elements. Additionally, it will be understood that any list of such candidates or alternatives is merely illustrative, not limiting, unless implicitly or explicitly understood or stated otherwise. Also, the use of "comprise", "comprises", "comprising", "contain", "contains", "containing", "include", "includes", and "including" are not intended to be limiting.

In addition, unless otherwise indicated, numbers expressing quantities of ingredients, constituents, reaction conditions and so forth used in the specification and claims are to be understood as being modified by the term "about", such that slight and insubstantial deviations are within the scope of the present teachings. Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

A new approach is provided for identifying molecules of a sample (the precursors) observed in mass spectra (MS) by their mass peak. Ions in a mass window around the mass peak are isolated, fragmented and then the mass spectrum ($MS^2$) of the fragments is detected to identify the molecule based on the fragment spectrum. This may be achieved in some examples by comparing the fragment spectrum with standard spectra in a library.

The sample may be eluted from a chromatography column and accordingly mass spectra may have to be detected from the eluted sample in certain time intervals. Accordingly, the time to detect the mass spectra ($MS^2$) of the fragments of observed molecules may be limited. As a result, it may be beneficial to define a ranking for a reasonable order in which to identify the observed precursors by $MS^2$ mass spectra.

Each molecule of the sample has an isotopic distribution (also called an "isotope distribution"). The isotopic distribution results from isotopologues of a molecule having different m/z values. Each isotopologue produces a peak in the mass spectrum. The ions corresponding to the isotopologues of the molecule may be analysed by collecting ions in a mass window that includes the isotopologues of the isotopic distribution. The mass window of the ions collected for further analysis is termed the "isolation window". The isolation window may be independent of the width of the isotopic distribution. Alternatively, the isolation window may be chosen based on the isotopic distribution (e.g. to be the same width as the isotopic distribution). In some examples, the width of the isolation window may be specified by the user (e.g. in a user interface for $MS^2$ scans).

Each precursor molecule present in the sample produces an isotopic distribution when the sample undergoes MS spectroscopy. The isotopic distributions in the scan can be analysed with the goal of identifying the corresponding precursor molecule. However, one problem is that in the mass range of the isotopic distribution of the ions of a molecule, mass peaks of the isotopic distribution of another molecule may also be observed. This effect of interference of the isotopic distributions of different molecules complicates the identification of molecules by their fragments observed in the $MS^2$ mass spectra substantially. Therefore, it is preferred to analyse mass peaks that are not influenced or not essentially influenced by the interference. Another term to describe the influence of interference is the "purity" of a mass range of a mass spectrum. So the order of detected $MS^2$ mass spectra should be related to the purity of the analysed mass range or the surroundings of the analysed mass peaks. For this task, a purity filter has been proposed which provides a purity or also called non-interference score. Example methods discussed in this application provide improved purity filters.

These techniques can also be used when analysing $MS^2$ scan data. For example, each fragment may have an isotopic distribution and these may overlap. If further fragmentation is required (e.g. in $MS^n$ spectroscopy) then the techniques described may be used to identify which fragments should be further analysed and in what order to do so, based on the purity of the isotopic distributions of the fragments. An isolation window around the fragments may also be determined based on the purity of the peaks in the isotopic distribution of the fragment.

One example of an improved method of implementing a purity filter identifies, for one or more isotopic distributions, one or more (preferably two) parameters characterising the interference of the isotopic distribution with another isotopic distribution and, for each isotopic peak in the isotopic distribution, one or more (preferably two) parameters characterising interference from the nearest interfering peak.

Isotopic distributions (also known as isotopic clusters) may be identified from a mass spectrum by an isotope and charge state defining algorithm or an advanced peak detection algorithm. This process is described in more detail in European Patent Application No. 17174330.5 (EP 3293755 B1), which is herein incorporated by reference. Other methods for identifying isotopic distributions from MS data are possible.

FIG. 1 shows a simplified example of a mass spectrum in which two isotopic clusters have been identified. As can be seen, the m/z ratio ranges of the two clusters overlap.

The parameters determined to define levels of interference may be used for filtering and ordering. For example, the purity of the isotopic distribution as a whole may be used for determining an order in which isotopic distributions should be analysed. Moreover, the purity of the individual isotopic peaks in the isotopic distribution (each identifying a level of interference from one or more interfering peaks in the vicinity of the isotopic peak) may be used to filter out certain peaks of the isotopic distribution before $MS^2$ analysis (e.g. by adjusting the isolation window to exclude peaks with poor interference scores). The one or more parameters defining the interference may be combined into a single score for each isotopic peak and/or for each isotopic distribution.

After isotopic distributions have been extracted from the mass spectrum of a sample, a m/z window $w_{ISD}$ and a purity value $p_{ISD}$ may be determined for each isotopic distribution. For each isotopic peak of an isotopic distribution the nearest interfering peak may be identified. The nearest interfering peak may be the nearest peak not belonging to the isotopic distribution (e.g. a peak belonging to a different isotopic distribution). In particular, the m/z distance $d_{interf}$ of this nearest interfering peak is determined as one parameter characterising the interference of each isotopic peak. Another parameter characterising the interference of each isotopic peak may be the isotopic peak purity $p_i$. The isotopic peak purity may be related to the relative abundance of the isotopic peak compared to the relative abundance of the interfering peak.

From one or more of the purity parameters determined, a purity score (or interference score) may be calculated for each isotopic peak and/or for each isotopic distribution. The interference score can be used as a sorting criterion to define the order in which to identify the observed precursors by $MS^2$ mass spectra or as a selection criterion, which precursors shall be investigated by $MS^2$ mass spectra. Then the score is the selection criterion of a purity filter defining which precursors can be identified.

The weighting of the different determined parameters may be combined in a single score. One way of doing this is by multiplying each parameter by a weighting factor and adding the parameters together.

A typical maximum value of 10 Thomson (10 u) may be assumed as the m/z width of an isotopic distribution. 1 Thomson may be defined as 1 u/e, where u is the unified atomic mass unit and e is the elementary charge.

A specific implementation of the APD-based purity filter developed for use in mass spectrometers is described below. This method may be implemented on a computer system and the instructions may be stored in computer software.

In general, purity filters provide a means to select and prioritize precursors based on the amount of interference in the proximity of the precursor. In this context, "interference" refers to any signal in the mass spectrum that does not belong to the same isotopic distribution (and thus chemical species) as the precursor of interest.

In the present invention, purity values are calculated individually for every isotopic distribution and their associated peaks found by a charge state detection algorithm (such as the Advanced Peak Determination (APD) algorithm of EP3293755B1) so as to avoid using predefined m/z windows. Moreover, the purity values may be used as a sorting criterion to process a list of candidate peaks by order of purity. For example, it may be beneficial to start with the "purest" candidate and continue in descending order of purity. This is particularly significant when the amount of MS' spectra has to be maximised for a given amount of time, without compromising the information provided. The samples for analysis may be eluted from a chromatography column. Samples may be collected from the column at fixed sample time intervals. Time for sample analysis may therefore be limited to the time between samples (before the next sample is eluted). During the fixed time interval between samples, the level of analysis that may be performed on the sample is limited. The purity values may therefore be used to guide the analysis so that more useful information may be obtained during the fixed interval.

Moreover, the abundance of precursor molecules in the eluted sample will vary over time. Therefore, a precursor may be subject to significant levels of interference from interfering molecules when a first eluted sample is analysed. However, when a second eluted sample is analysed after a time interval, the precursor molecule may be observed in higher abundance and the interfering molecules may be observed in lower abundance (or may have completely eluted by that time interval), resulting in improved purity scores for the precursor molecule. The precursor may therefore be identified at the second time period, when it has a higher purity score, rather than at the first time period.

Calculation of Purity Values

The following steps may be performed for each isotopic distribution found by the charge state detection algorithm. The APD algorithm is particularly suited for this approach, since it is capable of extracting a list of isotopic distributions from a given mass spectrum.

Purity of the Entire Isotopic Distribution

The isotopic envelope of an isotopic distribution is defined as a range of m/z values starting from the peak in the isotopic distribution having the lowest m/z value and ending with the peak in the isotopic distribution having the highest m/z value, including the end points. The width of the isotopic envelope is therefore given by the m/z distance between the lowest-m/z and highest-m/z isotopic peak of the ISD, considering all peaks that are likely to originate from the same chemical species. The isotopic envelope includes all the peaks of the isotopic distribution.

Figure 2A:
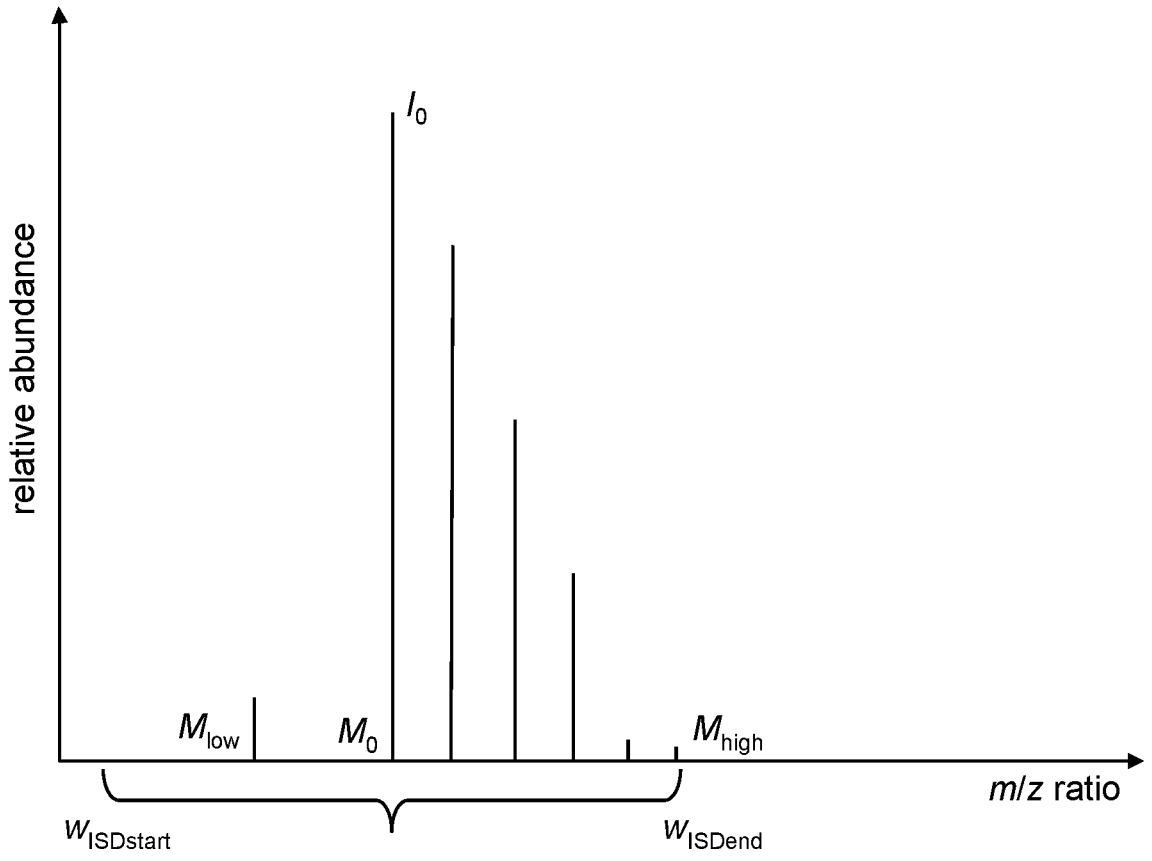
FIGS. 2A and 2B illustrate how an isotopic m/z window may be defined.

The purity of the isotopic distribution (ISD) is calculated using an individual m/z window, which is based on the isotopic envelope. This window is referred to in this application as "the m/z window", "the mass/charge (m/z) window" or "the isotopic m/z window" of the isotopic distribution and is denoted by $w_{ISD}$. The m/z window $w_{ISD}$ may be obtained by centring the window on the most abundant peak of the ISD and adjusting the width of the window until all peaks belonging to the ISD are included in the window (so that the window remains symmetric around the most abundant peak of the ISD). This is illustrated in FIG. 2A. More specifically, a half-width $W_{ISD/2}$ is calculated first:

$$w_{ISD/2}=\max(M_0-M_{low},M_{high}-M_0),$$

with $M_x$ being m/z values of isotopic peaks ($M_0$: most abundant peak of the ISD, $M_{low}$: lowest-m/z peak, $M_{high}$: highest-m/z peak). Then the window boundaries $w_{ISDstart}$, $w_{ISDend}$ are given by:

$$w_{ISDstart}=M_0-w_{ISD/2},$$

$$w_{ISDend}=M_0+w_{ISD/2},$$

such that $w_{ISDend}-w_{ISDstart}=2\cdot w_{ISD/2}=w_{ISD}$. In this way, the window is exactly large enough to meet the two conditions (centred on the most abundant peak in the ISD and includes all peaks in the ISD) and no wider.

In the approach described above, the m/z window $w_{ISD}$ is centred on the most intense peak. Therefore it is at least as wide as the isotopic envelope. This approach is advantageous because the most intense peak of the ISD is triggered preferentially for $MS^2$. However, the m/z window $w_{ISD}$ could be defined in other ways. For example, the m/z window $w_{ISD}$ could be centred on the average m/z value of the ISD. Alternatively, the m/z window $w_{ISD}$ may be identical to the isotopic envelope, i.e., defined by the lowest-m/z and highest-m/z peaks of the ISD.

The term $w_{ISD}$ may refer to the window defined by the start and end points of the m/z window ($w_{ISDend}$ and $w_{ISDstart}$). $w_{ISD}$ may also be used to refer to the m/z distance between the start and end points (i.e. $w_{ISD}=w_{ISDend}-w_{ISDstart}$).

The method of determining the m/z window $w_{ISD}$ assumes that the relationship between each peak in the MS data and a corresponding ISD is well-defined. In reality, some peaks may only be assigned to a particular ISD with a particular certainty. In some embodiments, peaks that are assigned to a particular ISD with a certainty below a particular threshold may be disregarded when determining the individual m/z window $w_{ISD}$.

Figure 2B:
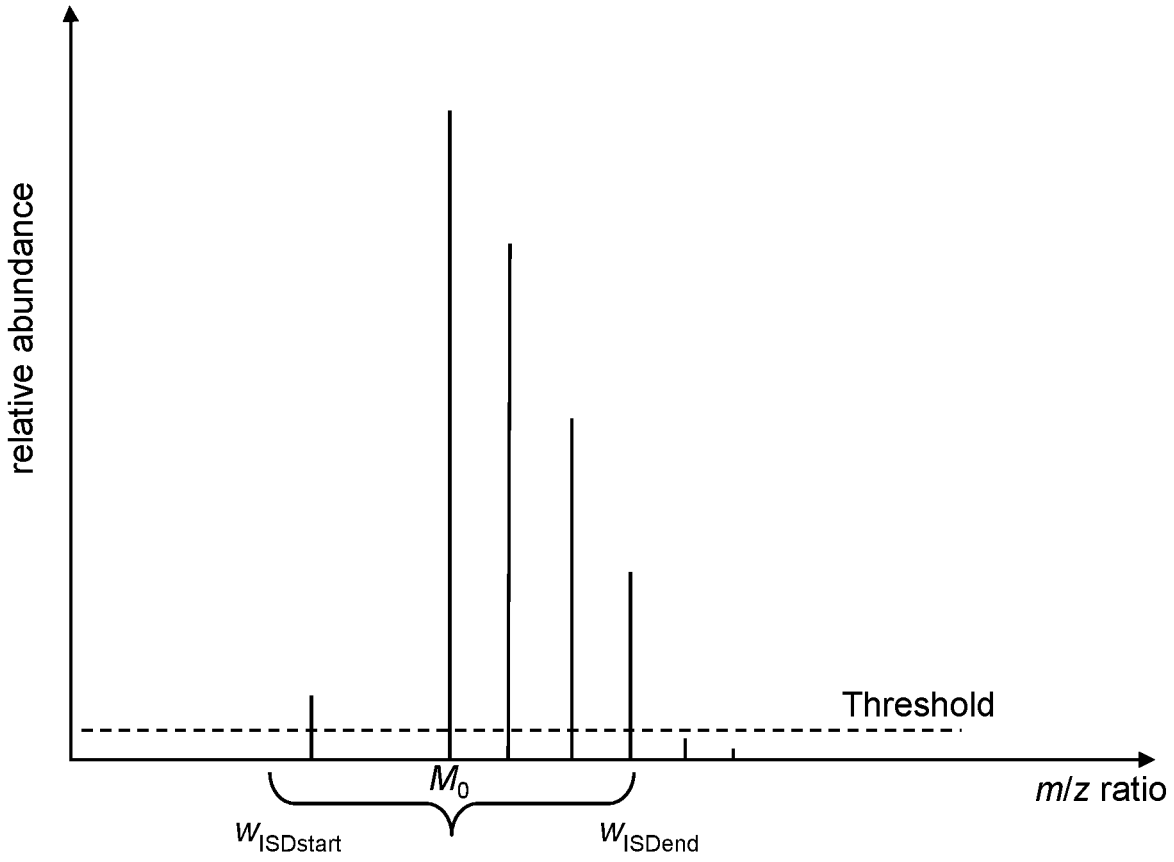

In a similar manner, peaks having an intensity (relative abundance) below a certain threshold may be disregarded when determining the individual m/z window $w_{ISD}$. This is illustrated in FIG. 2B.

All peaks detected in the m/z range $w_{ISDstart} \leq m/z \leq w_{ISDend}$ are checked with respect to their association with the ISD of interest. If a peak has been determined to belong to the same ISD with high probability, its intensity I is added to the isotopic intensity accumulator $S_{iso}$. Otherwise, its intensity is added to the interference intensity accumulator $S_{interf}$. If a peak belongs to multiple ISDs, including the ISD of interest, its intensity can be distributed proportionately to the accumulators. These proportions can be calculated, for example, based on intensity ratios of the associated ISDs. An alternative, simpler approach, consists of adding a fixed proportion of 50% to either accumulator if a peak is associated with multiple ISDs.

After processing the entire m/z window, the purity value $p_{ISD}$ is calculated as:

$$p_{ISD}=S_{iso}/(S_{iso}+S_{interf}),$$

with $0<p_{ISD}\leq 1$.

Purity of Isotopic Peaks

After calculating the purity value of the entire ISD, each isotopic peak of the ISD with m/z value $M_i$ and intensity $I_i$ is analysed individually with respect to the nearest interference peak within the m/z window of the ISD:

1. Store the intensity (relative abundance) of the isotopic peak in $I_i$.
2. Find the nearest interference peak (m/z value $M_{interf}$) within the m/z window $w_{ISD}$ of the ISD and store its intensity in $I_{interf}$ and its m/z distance in $d_{interf}=|M_{interf}-M_i|$.
3. Calculate the isotopic peak purity as $p_i=I_i/(I_i+I_{interf})$.

Note that if $p_{ISD}$ is 1 (i.e., there are no interference peaks within the window), $p_i$ must be 1 as well for all isotopic peaks. In this case, $d_{interf}$ can be set to the m/z distance between the isotopic peak and the nearest boundary of the window ($w_{ISDstart}$ or $w_{ISDend}$).

$$\text{If } p_{ISD}=1\text{: } d_{interf}=\min(M_i-w_{ISDstart}, w_{ISDend}-M_i)$$

$$\text{else: } d_{interf}=|M_{interf}-M_i|.$$

For performance reasons, it may be beneficial to skip the step of calculating the individual purities if the purity of the ISD is 100% (no interferences). It may also improve performance, without unduly affecting results, to skip the step of calculating the individual purities if the purity of the ISD is higher than a specified threshold, and then assigning the purity of the ISD to the individual peaks.

Each isotopic peak is annotated internally in the software with the value pairs ($p_i$, $d_{interf}$) and ($p_{ISD}$, $w_{ISD}$), which are used by the purity filter to assess the purity with respect to a purity window (which may be user-defined). Also, the value pairs may be combined to obtain a single number as a score, which can then be used as a sorting criterion for lists of precursor candidates in data-dependent experiments.

For example, to convert a pair of purity value and m/z width or distance (p, m) into a single 32-bit integer number/score, p is first multiplied by $10^6$, rounded to the nearest integer, and again multiplied by 1000, such that $1000\leq p\leq 10^9$. m is multiplied by 100 and rounded to the nearest integer, such that $0\leq m\leq 999$. Then both converted values are added to obtain an integer score. When used as a sorting criterion, this number format puts more emphasis on the purity than on the m/z width or distance. However, depending on the priorities of the user and targeted applications of the scoring mechanism, it may be beneficial to interchange the values, such that the m/z value is placed at the higher-order digits and the purity value at the lower-order digits.

Filtering Peaks Based on Purity (First Way)

Two different approaches to filtering based on purity score are provided. The first embodiment assumes a defined mass window width W.

The purity filter depends on two parameters: The purity window (W) in m/z units, and the purity threshold (T) in the range 0-1 (or 0-100%). The filter aims at filtering (excluding) candidate peaks with purity values below the threshold T, i.e., only peaks with purity values equal to or above T may pass the filter. The purity window defines the boundaries of the purity determination and is symmetric around the candidate peak, thus yielding the boundaries $$W_{start}=M_c-W/2,$$

$$W_{end}=M_c+W/2,$$

with $M_c$ being the m/z value of the candidate. The width of the purity window W for each of the candidate peaks may be predefined. This parameter may be defined by a user in a user interface. The width of the purity window may be one of the properties of the purity filter. The width of the purity window may in some cases be set equal to the width of the isolation window.

The candidate purity, $p_c$, may be interpolated from the parameters of the purity of the ISD, given by $p_{ISD}$ and $d_{interf}$. The window for calculating the candidate purity is usually centred on the candidate peak (although an asymmetry could be introduced by specifying an m/z offset, similar to the isolation offset).

This approach defines a purity value $p_c$ for a candidate peak having the m/z value $M_c$. If a candidate peak has been annotated beforehand with the purity value pairs as described above, the decision whether to filter (exclude) or pass (include) the peak can be made as follows:

1. If the purity of the entire isotopic distribution $p_{ISD}$ is 1, or if the purity window W does not include the nearest interfering peak to the candidate peak (i.e., $W/2<d_{interf}$), set the candidate purity $p_c=1$. In other words, if no interference peak is observed in the intended mass window of width W, the purity value $p_c$ has its maximum value 1.
2. Otherwise, if the purity window W is equal to or larger than the width of the m/z window $w_{ISD}$ ($W\geq w_{ISD}$), set $p_c=p_{ISD}$. I.e. if the whole m/z window $w_{ISD}$ of the isotopic distribution of the candidate is within the purity window of width W, the purity value of the isotopic distribution $p_{ISD}$ is most relevant. Likewise, when the distance of the next interfering peak $d_{interf}$ is the same as the value of $w_{ISD/2}$, set $p_c=p_{ISD}$.
3. If the purity window W is smaller than the mass/charge window $w_{ISD}$ of the complete isotopic distribution (i.e., $W<w_{ISD}$), and the next interference peak is within the purity window (i.e. $d_{interf}<W/2$), the individual isotopic peak purity $p_i$ of the candidate peak has more relevance and is taken into account. The formula for the purity value $p_c$ of a candidate, takes into account all four determined parameters for the calculation. The candidate purity $p_c$ may be calculated via linear interpolation:

a. Calculate slope $a=(p_{ISD}-p_i)/(w_{ISD/2}-d_{interf})$ and offset $b=p_i-a\cdot d_{interf}$.

Note that the slope is undefined if $w_{ISD/2}\cdot d_{interf}$. This case is caught in step 2.

b. Interpolate $p_c$ by calculating $p_c=a\cdot W/2+b$.

c. Exclude (filter) peak if $p_c<T$; include otherwise.

If a peak is not annotated with purity values (which is mostly expected for peaks with low signal-to-noise ratios), it should be filtered out by default.

Illustration of the third case above:

$$p_c=a\cdot W/2+b$$

$$\downarrow b=p_i-a\cdot d_{interf}$$

$$p_c=a\cdot(W/2-d_{interf})+p_i$$

$$\downarrow a=(p_{ISD}-p_i)/(w_{ISD/2}-d_{interf})$$

$$p_c=(p_{ISD}-p_i)\times(W/2-d_{interf})/(w_{ISD/2}-d_{interf})+p_i$$

Conditions:

$$W<w_{ISD}$$

$$d_{interf}<W/2$$

Figure 3:
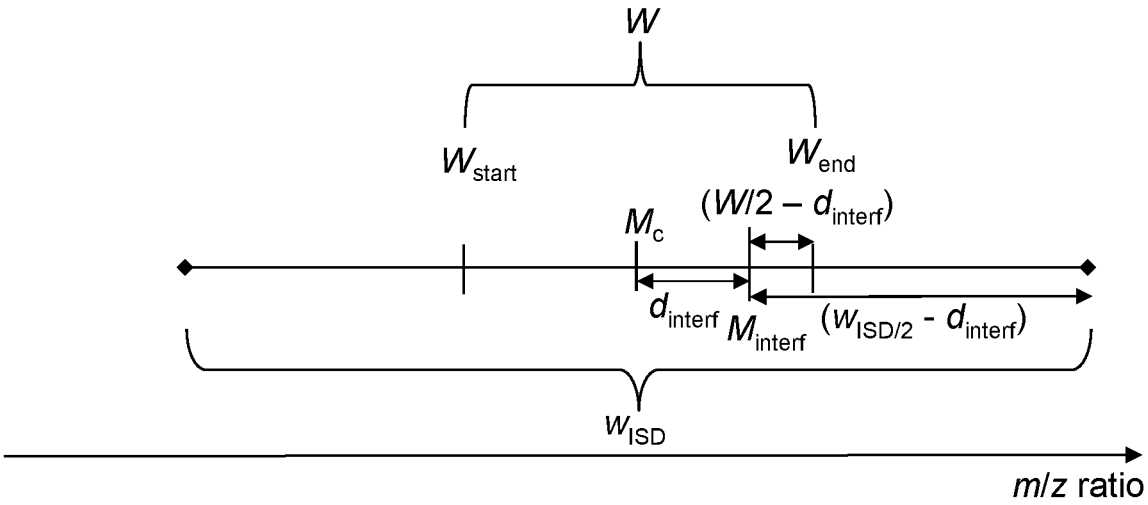
FIG. 3 illustrates determination of a candidate purity for a particular peak of an isotopic distribution.

FIG. 3 illustrates this calculation graphically. The values of $(W/2-d_{interf})$ and $(w_{ISD/2}-d_{interf})$ in the interpolation are illustrated in the Figure. The relationship between these values and the mass windows and distances to nearest interfering peaks can also be seen.

In the first embodiment, a predefined purity window (i.e. a user-defined purity window) is used to filter the peaks. Filtering is based on a pass or fail test. In other words, include a candidate peak if its purity value is above a user-defined threshold and exclude otherwise. This may help to avoid too strong interferences in the resulting $MS^2$ spectra. This purity filter may be part of a comprehensive filter library consisting of numerous filters for various peak characteristics (such as intensity, m/z, charge state, etc.). All these filters may perform a pass or fail (include/exclude) test to select candidates for $MS^2$ according to the user's requirements (for example, only candidates with charge state>1, intensity>1e4, and/or purity>0.8 may be included in $MS^2$ analysis). In many cases the user may set the purity window equal to the isolation window of the $MS^2$ experiment. However, this is not mandatory.

Filtering Peaks Based on Purity without Prior Knowledge of Isolation/Purity Window (Second Way)

A second way of determining these interference parameters (scores) is provided below that does not require prior knowledge of the isolation window W. In other words, the user does not need to set a predefined purity window. The information derived from this second way can advantageously be used for choosing an isolation window for fragmentation.

The purity values of the entire isotopic distribution $p_{ISD}$ and the individual isotopic peaks $p_i$ are calculated in a similar manner to the first way described above.

Figure 4A:
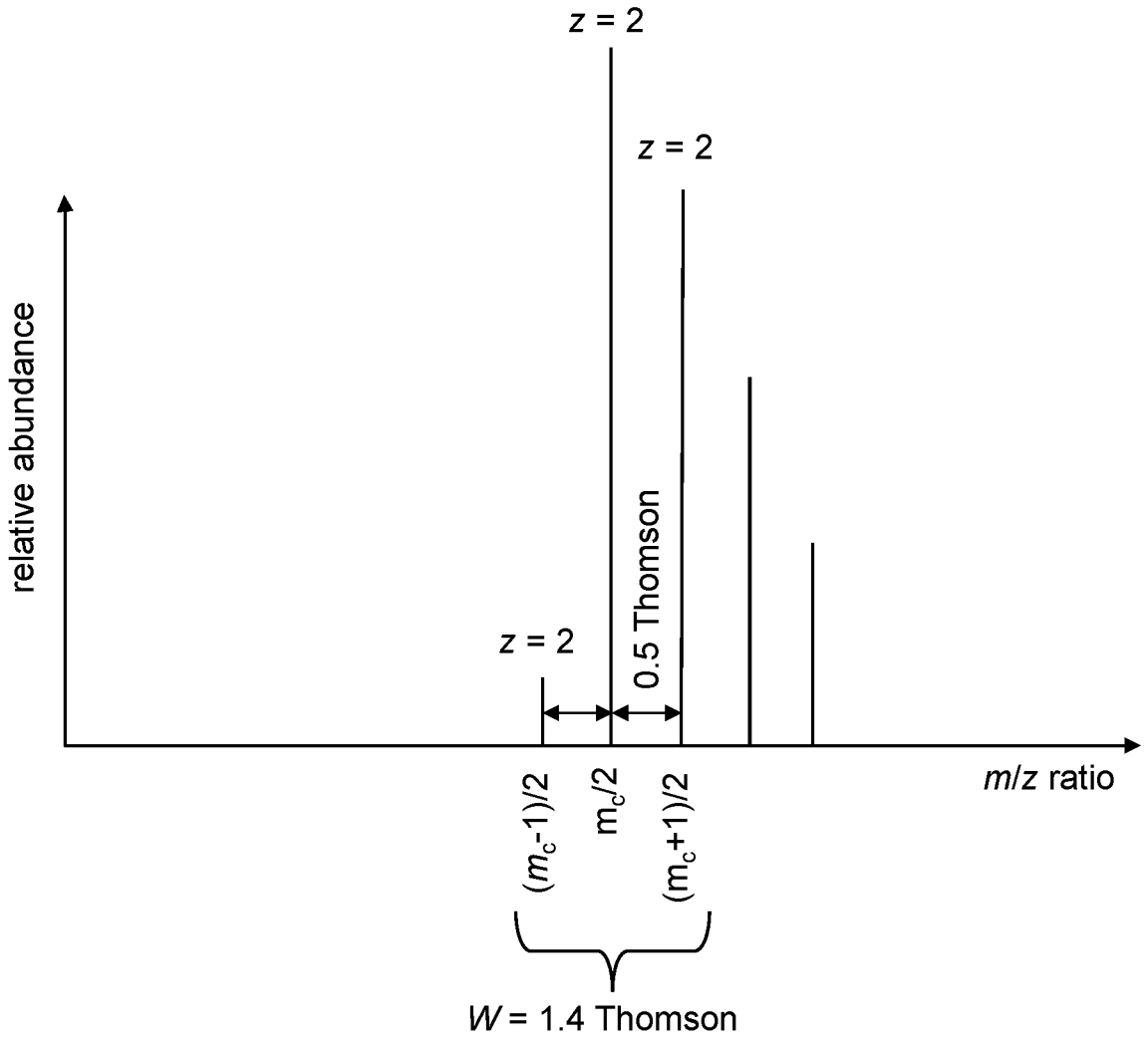
FIGS. 4A and 4B illustrate distances between neighbouring peaks (whose masses differ by approx. 1 amu) for ions with charge values z=2 and z=3.

In the second embodiment, an approach is provided that is independent of a specific mass window width W, for which the $MS^2$ mass spectra are detected (the isolation window). This approach is based on the fact that in a mass window of 1.4 m/z units (Thomson) for a charge state of z=2, one neighbour peak of an isotopic distribution can be observed with an increased mass and one neighbour peak of an isotopic distribution can be observed with a reduced mass. This is illustrated in FIG. 4A. Moreover, for a charge state of z=3 two neighbour peaks of an isotopic distribution of increased mass can be observed and two neighbour peaks of an isotopic distribution of reduced mass can be observed. This is illustrated in FIG. 4B (not to scale).

Figure 4B:
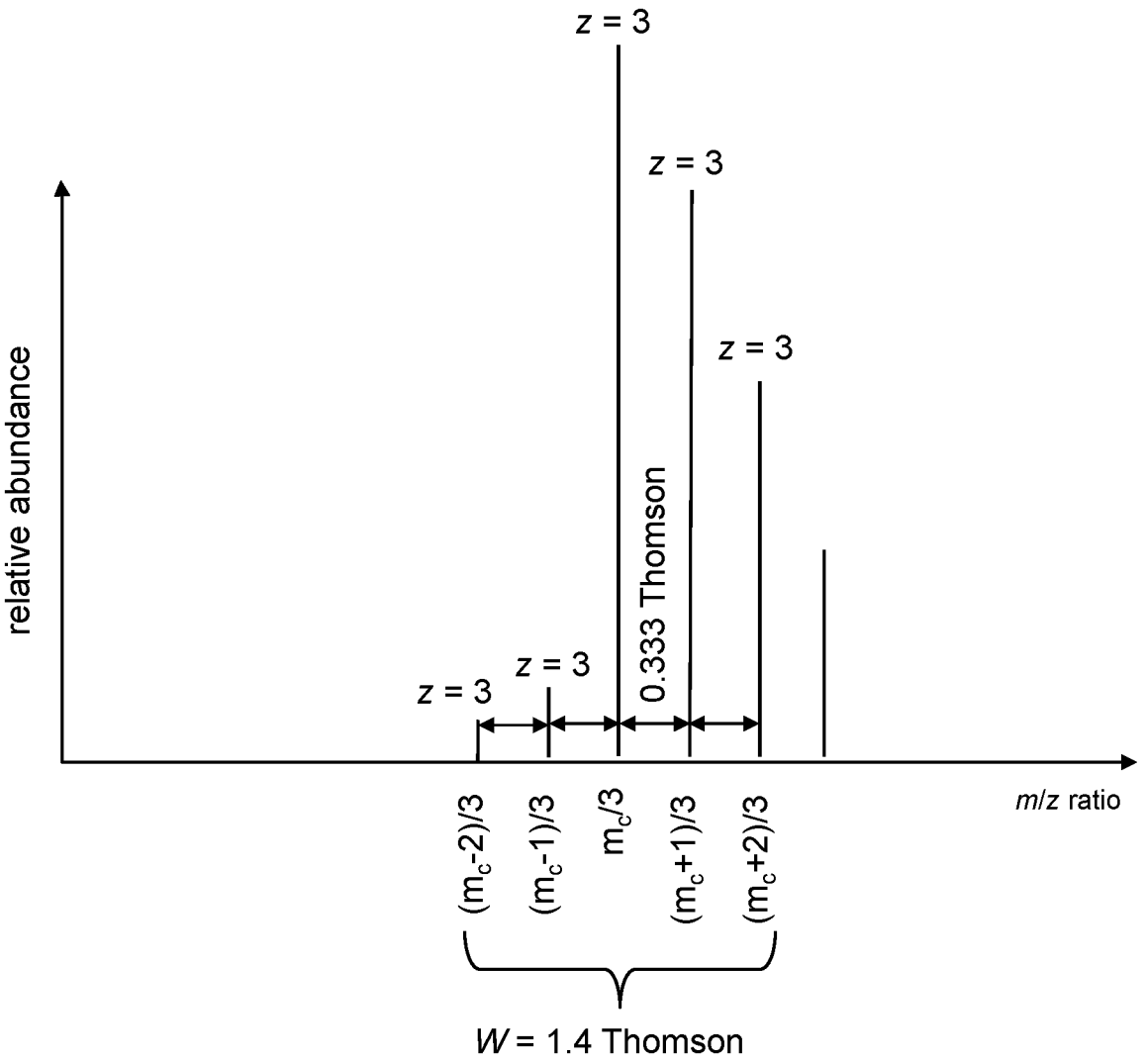

It should be noted that in the field of proteomics, precursors with z=1 are generally of low interest (as they often originate from non-analyte background ions) and therefore may be filtered out by a charge state filter. For other applications such as small molecules, in which precursors with z=1 are more interesting, the 1.4-m/z window may be adjusted to also include the adjacent isotopic peak. The purity-based precursor selection techniques described in this application may be especially beneficial to proteomics applications (discovery experiments) due to higher sample complexity and largely unknown peptides in the sample (this is in contrast to non-proteomics applications, which generally have lower sample complexity and a target-oriented workflow).

Where FIGS. 4A and 4B refer to m/z values of "$(m_c+1)/2$", "$(m_c+2)/3$", "$(m_c-1)$", "$(m_c-2)$" etc., the "+1" or "−1" refers to a difference in mass of approximately 1 atomic mass unit (amu). The "/2" or "/3" refers to an ion charge of 2e or 3e, where e is the elementary charge. This is a simplified illustration. The skilled person will understand that the exact spacing between the peaks of the mass spectrum may not be identical between isotopologue species.

Moreover, the skilled person will further appreciate that different isotopologues may produce peaks having nearly identical m/z values but not exactly the same. For example, peaks having an m/z value 1 m/z unit higher than the most abundant species (in the "$m_0+1$" position for a charge value of z=1) may have slightly different m/z values. If the $m_c$ peak related to $^{12}CH_3^+$ ions, there may be two peaks in the "$m_c+1$", the first belonging to $^{13}CH_3^+$ and the second belonging to $^{12}CH_2D^+$. These peaks at low resolution appear to have identical m/z values differences in the m/z values may be observed at high resolution.

Accordingly if the distance $d_{interf}$ of the next interfering peak is higher than 0.7 m/z units, the candidate peak is closer to the neighbouring peaks of the ISD than to the interfering peak. Accordingly, the influence of these interfering peaks can be considered to be small and the purity value approximates the purity score for the entire ISD. This approach is therefore not related to a specific mass window width W.

It is recognised that there are benefits in attributing a different interference score on each isotope peak of a cluster, without prior knowledge of an isolation window to be used for fragmentation. The information derived can be used for choosing an isolation window for fragmentation. This process may be achieved through the following steps:

a) Isotopic clusters are defined at $MS^1$ using an isotope and charge state defining algorithm (e.g. APD)

b) Every peak is examined and attributed to an isotopic cluster. When isotopic clusters overlap a "cluster overlap score" (or isotopic purity $p_{ISD}$) is defined, which is identical for all peaks belonging to the isotopic cluster (also called "isotopologues"). In one implementation, the cluster overlap score is given by the total intensity of the isotopic peaks normalized to the total intensity of isotopic and interfering peaks within the isotopic cluster m/z range, which is symmetric around the most abundant isotopic peak and includes both the lowest-m/z and highest-m/z isotopic peak of the cluster. Other methods can also be used for the assignment of the "cluster overlap score".

c) Each peak of the isotopic cluster is examined and an m/z distance value from the nearest interference, together with the normalized intensity of the interfering peak are used in order to rescore each isotopic peak. If there is more than one interfering peak within the isotopic cluster m/z range, the nearest one above an intensity/significance threshold is selected.

d) A list of parent ions is used, and the mass spectrometer moves through the most intense peak with the best non-interference score towards to the less intense peak with the worst interference score.

A decision matrix of intensity/interference score can also be used for different types of experiments in order to maximise the utilisation of this information.

e) When filtering precursors based on the amount of interference within a given isolation window, the amount of interference of a precursor within an isolation window that is smaller than or equal to the isotopic cluster width of the precursor can be estimated by exploiting both the interference score (which only takes the nearest significant interference into account) and the cluster overlap score (which takes the entire isotopic cluster into account).

Advantageously, this method can be performed without prior knowledge of the isolation window. Moreover, the isolation window for fragmentation can be adjusted automatically according to the "interference score" of each peak of interest, thus preserving sensitivity on low intensity peaks with good interference score (e.g. using a wider window).

Application of Purity Values

The value pairs ($p_i$, $d_{interf}$) and ($p_{ISD}$, $w_{ISD}$) can be combined to obtain a single number as a score for the isotopic peak. This score (a) may be used as a sorting criterion for lists of precursor candidates in data-dependent experiments, or (b) it may serve as a selection criterion for a purity filter.

Example: Purity Score as a Sorting Criterion

To convert a pair of purity value and m/z width or distance (p, m) into a single 32-bit integer number/score, p is first multiplied by $10^6$, rounded to the nearest integer, and again multiplied by 1000, such that $1000 \le p \le 10^9$. m is multiplied by 100 and rounded to the nearest integer, such that $0 \le m \le 999$. Then both converted values are added to obtain an integer score. When used as a sorting criterion, this number format puts more emphasis on the purity than on the m/z width or distance. However, depending on the priorities of the user and targeted applications of the scoring mechanism, it may be beneficial to interchange the values, such that the m/z value is placed at the higher-order digits and the purity value at the lower-order digits.

Ordering the candidate peaks may provide advantages for the workflow of the peak filtering mechanism, which can operates on spectral peaks rather than isotope distributions. Also, filtering the individual peaks allows selecting those peaks in an ISD that are farthest from an interference within the ISD. For example, if the interference is close to the most intense peak of the ISD (=small distance), isotope peaks with higher distances and thus higher integer scores may preferentially be selected for $MS^2$.

Example: Purity Score as a Selection Criterion (Purity Filter)

A purity filter filters (excludes) candidate peaks with purity values below a user-defined threshold T ($0 \le T \le 1$), i.e., only peaks with purity values equal to or above T may pass the filter and then serve as potential candidates for data-dependent MS/MS experiments.

For compatibility with this filter, the purity value pairs have to be converted into a single isotopic purity score $s_i$ ($0 < s_i \le 1$). Without prior knowledge of a user-defined purity window, the purity value can be weighted by the isotope-specific m/z distance $d_{interf}$ from the nearest interference, so that the score increases (i.e., improves) with increasing distance. This could be achieved, for example, by taking the k-th root of the purity value with k as a function of distance:

$$s_i = \min(p_{ISD}, p_i)^{1/k} \text{ with } k = 1, 2, 4, 8, \ldots \text{ (powers of 2)}$$

Using the minimum value of the purity of the entire isotopic distribution, $p_{ISD}$, and the purity of the isotopic peak, $p_i$, emphasizes the individual environment of the isotopic peak. Typically, isolation windows for peptides with common charge states z of 2 or 3 have a width of ~1.4 m/z units in order to include the second isotopic peak (z=2) and additionally the third isotopic peak (z=3). This window dimension corresponds to a half-width of ~0.7 if the window is symmetric around the precursor peak (which is mostly the case). Based on these assumptions, k is chosen according to the m/z distance din discrete steps of 0.7 m/z units:

$$k = 2^n \text{ if } 0.7n \le d < 0.7(n+1),\ n = 0, 1, 2, \ldots$$

i.e.:

$$k = 1 \text{ if } d < 0.7$$

$$k = 2 \text{ if } 0.7 \le d < 1.4$$

$$\ldots$$

d can be set equal to $d_{interf}$. Alternatively, d can be set to the minimum of $d_{interf}$ and the half-width of the mass/charge window of the isotopic distribution, $w_{ISD/2}$, (d min($d_{interf}$, $w_{ISD/2}$)). This may avoid artificially high purity scores for peaks at the edges of the mass/charge window $w_{ISD}$. For example, the score for an isotopic peak with d=2, $p_{ISD}$=0.5, $p_i$=0.8 is $s_i = 0.5^{1/4} = 0.84$.

It may be advantageous to choose higher thresholds for larger isolation windows. This is at least because the score increases with increasing distance from the nearest interference peak.

Whilst the above description provides techniques in which the mass/charge window $w_{ISD}$ of the isotopic distribution and the isolation window are both centred on the most abundant peak, it is not essential that this should be the case. One could allow the user to specify an offset for each of these parameters (similar to the isolation offset that is available in the properties of $MS^2$ scans) to introduce some kind of asymmetry in the purity calculation.

In principle, there are multiple options with respect to the m/z window for which the purity of the ISD is calculated:

- A window centred around the most intense peak, including all peaks of the ISD (as suggested above).
- A window centred around the average m/z value of the ISD.
- A window defined by the lowest-m/z and highest-m/z peaks of the ISD.

In practice, the common workflow of data-dependent experiments normally trigger the (filtered) peaks in descending order of intensity. As a result, the present disclosure provides a window centred around the most intense peak, including all peaks of the ISD (above a threshold). This may provide certain practical advantages.

What is claimed is:

1. A method of data-dependent mass spectrometry comprising:

generating mass spectrometer (MS) scan data comprising a plurality of peaks by performing a first MS scan, each peak having a respective mass-to-charge ratio and a relative abundance;

recognizing an isotopic distribution comprising a subset of two or more of the plurality of peaks of the MS scan data, the isotopic distribution corresponding to a precursor molecule;

determining one or more interference parameters for a particular peak of the isotopic distribution, wherein the one or more interference parameters include a peak purity, $p_i$, for the particular peak;

setting or determining the peak purity value, $p_i$, for the particular peak by either;

determining that there are no interfering peaks relevant to the isotopic distribution and setting the peak purity value, $p_i$, at a maximum purity value; or identifying one or more interfering peaks from the MS scan data, wherein the one or more interfering peaks do not belong to the subset of peaks of the isotopic distribution, and determining the peak purity, $p_i$, for the particular peak based on: the relative abundance, $I_i$, of the particular peak, and the relative abundance of the one or more interfering peaks; and generating a purity score for the particular peak of the isotopic distribution that is based, at least in part, on the peak purity value, $p_i$, and performing one or more mass analyses of ions corresponding to one or more peaks of the isotopic distribution, wherein either a sequence of the mass analyses or mass-to-charge values of the mass-analyzed ions are determined based on the purity score and on purity scores of other particular peaks of the isotopic distribution.

2. The method of claim 1, wherein the peak purity value, $p_i$, for the particular peak of the isotopic distribution is determined based on the relative abundance(s) of the one or more interfering peaks and comprises selecting a first interfering peak of the one or more interfering peaks and determining the peak purity value, $p_i$, for the particular peak of the isotopic distribution based on the relative abundance, $I_{interf}$, of the first interfering peak.

3. The method of claim 2, wherein the interfering peak is a nearest interfering peak having a relative abundance above an interference threshold, such that the mass-to-charge ratio of the first interfering peak is closer to the mass-to-charge ratio of the particular peak of the isotopic distribution than any other peak in the MS scan data not belonging to the subset of MS-scan-data peaks in the isotopic distribution and having a relative abundance above the interference threshold.

4. The method of claim 2, wherein the one or more interference parameters further include an interference distance, $d_{interf}$, for the particular peak of the isotopic distribution, wherein the interference distance, $d_{interf}$, is based on the difference between the mass-to-charge ratio, $M_i$, of the particular peak of the isotopic distribution and the mass-to-charge ratio, $M_{interf}$, of the first interfering peak.

5. The method of claim 1, wherein the one or more interference parameters further include an isotopic m/z window, $w_{ISD}$, of the isotopic distribution wherein the isotopic m/z window defines a range of mass-to-charge ratios that includes every peak of the isotopic distribution having a relative abundance above an inclusion threshold, wherein the purity score for the particular peak of the isotopic distribution is based, in part, on $w_{ISD}$.

6. The method of claim 5, wherein:

i) the isotopic m/z window is centered on a mass-to-charge ratio, $M_0$, of a most abundant peak of the isotopic distribution having the highest relative abundance, $I_0$, of the peaks in the isotopic distribution and wherein a half-width, $w_{ISD/2}$, of the isotopic m/z window is defined as the absolute difference between the mass-to-charge ratio of the most abundant peak of the isotopic distribution and the mass-to-charge ratio of a furthest significant peak of the isotopic distribution, wherein the furthest significant peak has:

a) a relative abundance above the inclusion threshold; and b) a mass-to-charge ratio that is furthest from the most abundant peak of the isotopic distribution, such that the absolute difference between the mass-to-charge ratio of the furthest significant peak and the most abundant peak is greater than the absolute difference between the mass-to-charge ratio of the most abundant peak and any other peak in the isotopic distribution having a relative abundance above the inclusion threshold; and ii) the setting or determining of the peak purity value, $p_i$, for the particular peak comprises either:

a) determining that there are no interfering peaks relevant to the isotopic distribution by determining that the range of mass-to-charge ratios defined by the isotopic m/z window does not contain any peaks that do not belong to the subset of peaks of the isotopic distribution and have a relative abundance above an interference threshold; or b) identifying one or more interfering peaks from the MS scan data by identifying peaks having a mass-to-charge ratio within the isotopic m/z window and having a relative abundance above an interference threshold.

7. The method of claim 5, wherein the one or more interference parameters further include an isotopic purity, $p_{ISD}$, for the isotopic distribution, wherein the purity score for the particular peak of the isotopic distribution is based, in part, on $p_{ISD}$, the method further comprising:

determining a total relative abundance, $S_{iso}$, of the subset of peaks belonging to isotopic distribution;

determining the total relative abundance of all of the peaks in the MS scan having a mass-to-charge ratio falling within the range defined by the isotopic m/z window; and using the total relative abundance for the subset of peaks, $S_{iso}$, and the total relative abundance for all of the peaks in the isotopic m/z window to determine the isotopic purity, $p_{ISD}$.

8. A method of data-dependent mass spectrometric analysis the that depends on MS scan data that comprises a plurality of peaks, each peak having a respective mass-to-charge ratio and a relative intensity, wherein a subset of the plurality of peaks corresponds to an isotopic distribution, the method comprising:

(i) determining a peak purity, $p_i$, for each peak of the isotopic distribution by:

determining that there are no interfering: peaks relevant to the isotopic distribution and setting the peak purity value, $p_i$, at a maximum purity value; or identifying one or more interfering peaks from the MS scan data, wherein the one or more interfering peaks do not belong to the subset of peaks of the isotopic distribution, and determining the peak purity, $p_i$, for the particular peak based on: the relative abundance, $I_i$, of the particular peak, and the relative abundance of the one or more interfering peaks;

(ii) determining a purity score, $s_i$, for each peak of the isotopic distribution that is based, at least in part, on the peak purity;

(iii) defining a lower boundary, $W_{start}$, and an upper boundary, $W_{end}$, of an isolation window so that only peaks of the isotopic distribution having a purity score greater than a predetermined threshold, T, are included in the isolation window;

(iv) isolating only ions that correspond to peaks that have mass-to-charge ratios that are within the isolation window; and (v) either fragmenting or mass analyzing the isolated ions.

9. The method of claim 8, wherein:

the purity score, $s_i$, of each peak is further based on one or more of:

a) an isotopic m/z window, $w_{ISD}$, of the isotopic distribution that is defined as a ran e of mass-to-charge ratios that includes every-peak of the isotopic distribution having a relative abundance above an inclusion threshold;

b) an isotopic purity for the isotopic distribution, $p_{ISD}$, that is determined from a ratio between a total relative abundance, $S_{iso}$, of a subset of peaks belonging to the isotopic distribution and the total relative abundance of all of the peaks in the MS scan having a mass-to-charge ratio falling within the range defined by the isotopic m/z window; and c) an interference distance, $d_{interf}$, for the respective peak that is based on the difference between the mass-to-charge ratio, $M_i$, of the respective peak of the isotopic distribution and the mass-to-charge ratio, $M_{interf}$, of a first interfering peak.

10. The method of claim 8, wherein the isolation window is centered around a peak of the corresponding subset of the plurality of peaks having the highest relative abundance and wherein setting the lower boundary of the isolation window and the upper boundary of the isolation window comprises defining a width of the isolation window.

* * * * *